United States Patent [19]

Trapp

[11] Patent Number: 4,674,686

[45] Date of Patent: Jun. 23, 1987

[54] PORTABLE FIRE APPARATUS MONITOR

[75] Inventor: James M. Trapp, Galien, Mich.

[73] Assignee: Elkhart Brass Manufacturing Co., Inc., Elkhart, Ind.

[21] Appl. No.: 656,072

[22] Filed: Sep. 28, 1984

[51] Int. Cl.[4] ..... B05B 15/06; A62C 31/28

[52] U.S. Cl. ..... 239/279; 169/24; 239/280.5; 239/587; 285/277; 285/317; 285/921

[58] Field of Search ..... 169/51, 52, 24; 239/273, 587, 279–280.5; 285/277, 317, DIG. 22, 168, 921

[56] References Cited

U.S. PATENT DOCUMENTS

| | | | |
|---|---|---|---|
| 1,923,588 | 8/1933 | Robinson | 239/280.5 X |
| 2,067,044 | 1/1937 | Corley | 239/280.5 X |
| 2,501,639 | 3/1950 | Warren | 285/168 |
| 2,660,456 | 11/1953 | Meddock | 285/317 X |
| 2,998,199 | 8/1961 | Miscovich | 239/587 |
| 3,011,239 | 12/1961 | Price et al. | 285/277 X |
| 3,796,448 | 3/1974 | Ringkamp | 285/317 |
| 4,124,228 | 11/1978 | Morrison | 285/317 X |
| 4,392,618 | 7/1983 | Evans et al. | 169/24 X |

FOREIGN PATENT DOCUMENTS

| | | | |
|---|---|---|---|
| 1005629 | 4/1952 | France | 239/280.5 |

OTHER PUBLICATIONS

Akron Brass Company, advertisement, Style 3422, Apollo (2 pgs.), published 6/83.

*Primary Examiner*—Andres Kashnikow

*Attorney, Agent, or Firm*—James D. Hall; Thomas J. Dodd

[57] ABSTRACT

A monitor which is for directing fluid flow from a fire truck pumper and which includes a spring biased latch pin securing the monitor to either a portable or permanent mount having a circumferential swivel bearing.

14 Claims, 12 Drawing Figures

Fig. 5
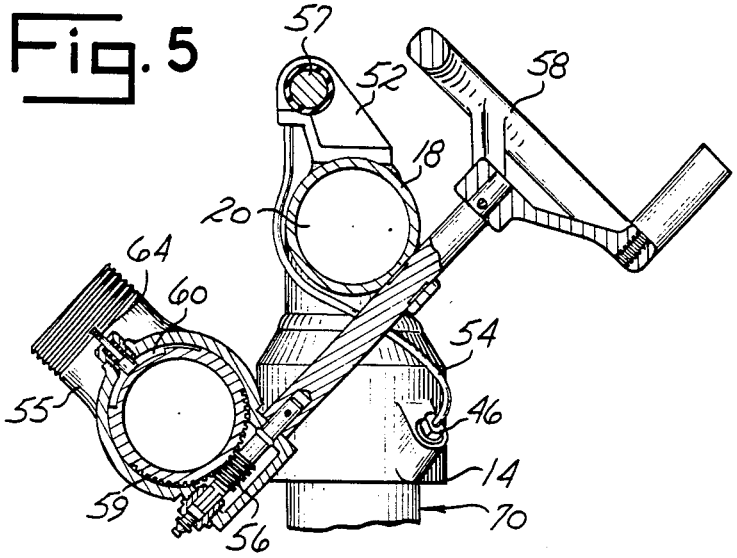
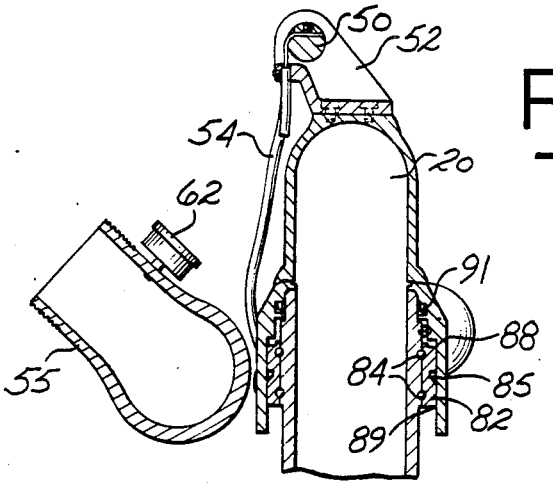
Fig. 6

PORTABLE FIRE APPARATUS MONITOR

SUMMARY OF THE INVENTION

This invention relates to a monitor and will have special but not limited application to a portable fire fighting monitor which may be utilized either on a pumper or similar type fire truck or with a ground stand.

A monitor is a specialized piece of fire fighting equipment used in conjunction with a nozzle to direct water at a high flow rate, such as from 350 to 1000 gallons per minute, towards the fire. A typical monitor is pivotable in a generally horizontal plane to allow fluid flow through an attached nozzle. Previously, monitors were of two types, namely a fixed unit permanently mounted to a fire engine pumper, and a portable unit having legs for directing water while at a distance from the pumper. Recently, a portable monitor capable of being transfered between a pumper mount and a portable mount and having a bolt disconnecting mechanism was introduced. The disconnect of this monitor requires the alignment and positioning of a bolt within a housing slot. Also such a monitor uses a different water inlet for each pumper mount and portable stand operation.

The monitor of this invention is a portable, convertible unit which may be mounted quickly and safely to a fire engine pumper or to a portable stand. The monitor includes snap-fitting latch pins which fit beneath a swivel bearing on the monitor mount and which secure the monitor in place during fire fighting operation and provide for quick connection to and disconnection from the mount.

Accordingly, it is an object of this invention to provide for an improved fire fighting monitor.

Another object of this invention is to provide for a portable monitor which may be quickly converted from use on a truck mount to a ground mount.

Another object of this invention is to provide for a portable monitor which is safe to use.

Still another object of this invention is to provide for a portable monitor which is efficient and economical.

Still another object of this invention is to provide a monitor having a portable mount with collapsible legs.

Other objects of this invention will become apparent upon a reading of the following specification.

BRIEF DESCRIPTION OF THE DRAWINGS

A preferred embodiment has been chosen to illustrate the principles of the invention wherein:

FIG. 5 is a sectional view taken along line 5—5 of FIG. 4.

FIG. 6 is a sectional view taken along line 6—6 of FIG. 4.

DESCRIPTION OF THE PREFERRED EMBODIMENT

Figure 1:
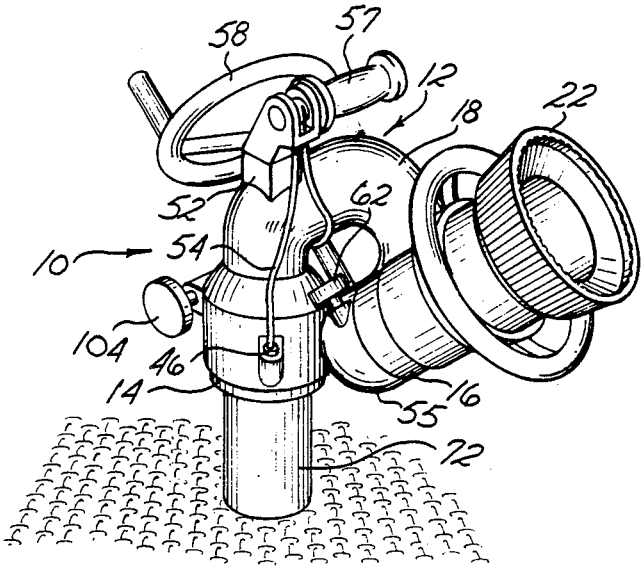
FIG. 1 is a perspective view of the monitor mounted to a fire truck.

The preferred embodiment herein described is not intended to be exhaustive or to limit the invention to the precise form disclosed. It is chosen and described to explain the principles of the invention and its application and practical use to enable others skilled in the art to utilize the invention.

The portable monitor 10 of this invention is part of an assembly which includes a fixed mount 70 and a portable mount 86. Monitor 10 includes a housing 12 having an annular inlet 14, an outlet 16, and a body portion 18 which form a continuous passageway 20 between the inlet and the outlet. A nozzle 22 is attached to outlet 16 and directs fluid flow from the outlet towards the fire area.

Figure 7:
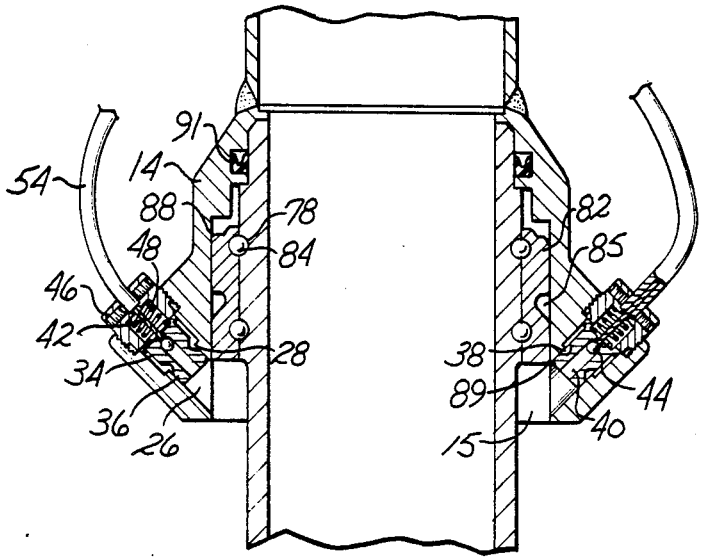
FIG. 7 is a sectional view taken along line 7—7 of FIG. 4 showing the latch pins in an open position.
Figure 8:
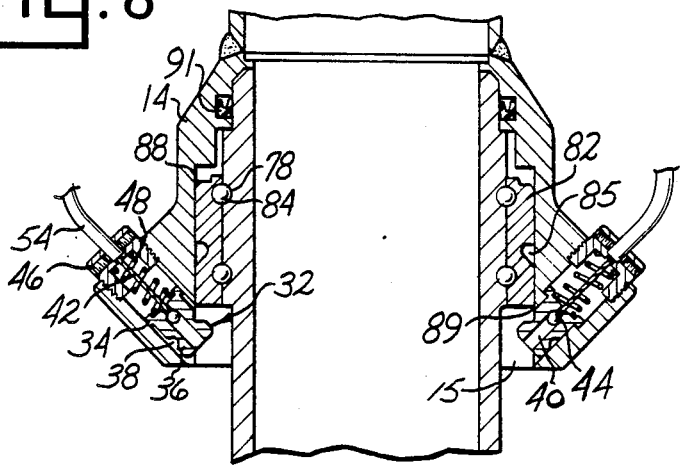
FIG. 8 is a sectional view similar to FIG. 7 showing the pins in their locked position during no fluid flow through the monitor.
Figure 9:
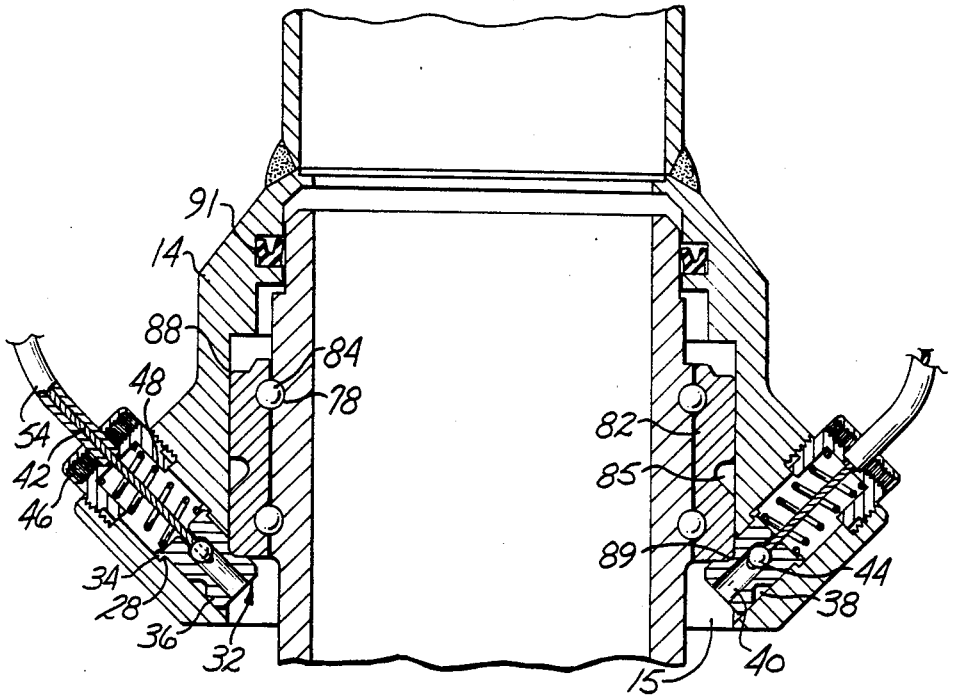
FIG. 9 is a sectional view similar to FIG. 8 showing the pins in their locked position during fluid flow through the monitor.

Housing 12 at inlet 16 includes diametrically located bores 26 which are oriented angularly downwardly towards the mouth 15 of inlet 14. Each bore 26 includes a step 28. A pin 32, being of the general shape shown in FIGS. 7–9, is slidably fitted within each bore 26. Each pin 32 includes a flanged head 34, and a body 36 having a circumferential groove 38. A bore 40 extends through each pin 32 and is of a reduced diameter at pin head 34. A cable 42 extends into each bore 40 with a stop 44 being connected to one end of the cable to secure the cable to the bore defining pin 32. Each pin 32 is held within its respective bore 26 by a threaded cap member 46. A spring 48 fits between each pin 32 and cap member 46 to urge the pin into its lock position shown in FIGS. 8 and 9. When each pin 32 is urged by contacting spring 48 into its lock position, a portion of pin body 36 which includes groove 38 protrudes from its retaining bore 26 of the housing 12. Each cable 42 extends upwardly from its attached pin 32 and is connected at its opposite end to a shaft 50 which is journalled within a bracket 52 connected to housing body portion 18. Cable 42 is preferably housed within a durable metal sheath 54. Connected to shaft 50 is a handle 57 which upon turning controls the tension in cables 42 and causes pins 32 to be pulled into housing bores 26 and to assume their unlocked positions such as shown in FIG. 7.

The outlet 16 is contained within a pivotable elbow 55 of housing 12. Elbow 55 includes a threaded part 59. A worm screw 56 engages threaded portion 59 of elbow 55 and is connected to a turn wheel 58. Rotation of wheel 58 causes the pivotal movement of elbow 55. Elbow 55 also includes a notch 60. A lock pin 64 extends into notch 60 to prevent the elbow from directing fluid flow at discharge angles below approximately 35° above horizontal without manually removing pin 64 from notch 60. A pressure gauge 62 is secured to elbow 55.

Figure 3:
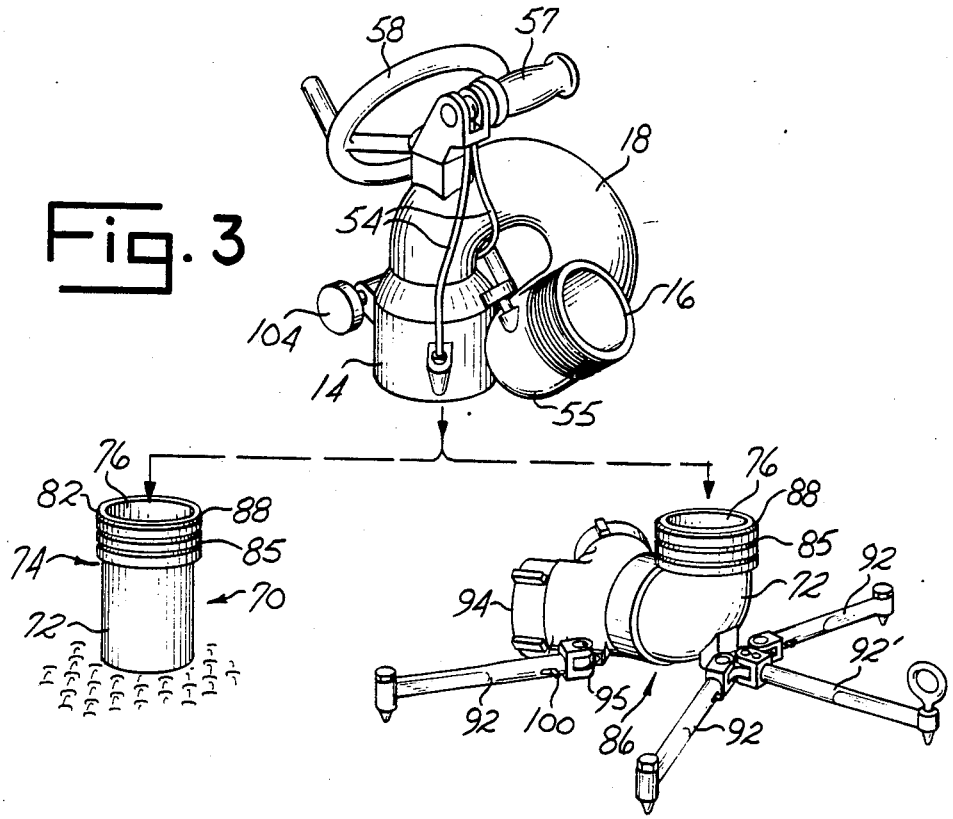
FIG. 3 is an exploded view of the monitor and the fire truck and portable mounts.

As shown in FIG. 3, monitor 10 may be connected to either a fixed mount 70 which is positioned atop a fire engine pumper or a portable mount 86. Mount 70 includes a conduit 72 which is in flow communication with the water supply contained in the pumper. Mount 70 also includes a cylindrical housing 74 having an internal waterway 76. A pair of spaced annular grooves 78,80 extend about mount housing 74. A swivel bearing 82 extends about mount housing 74 and is rotatable about the housing through bearings 84 which ride within grooves 78,80. Swivel bearing 82 includes a bevelled upper end 88 and a lower flat edge or shoulder 89.

Monitor 10 is utilized with mount 70 in the following fashion. An operator first aligns monitor inlet 14 with mount housing 74. The monitor is then pushed down over the mount housing 74 with the lower exposed ends of pins 32 first contacting the bevelled end 88 of mount bearing 82. This causes the pins 32 to be cammed inwardly into housing bores 26, compressing pin springs 48 relative to cables 42 until the neck 36 of each pin clears shoulder 89 of the swivel bearing 82. Pins 32 are then extended into their locked positions shown in FIG. 8 due to the influence of springs 48. When water is flowing through the mount 70 and monitor 10, the water pressure causes monitor housing 12 to be lifted slightly, as seen in FIG. 9, causing engagement of the pins 32 at their grooves 38 with the shoulder 89 of the swivel bearing 82. This firmly secures the monitor 10 to mount 70. A seal 91 carried by housing inlet 14 prevents water leakage between the monitor and mount. As a failsafe feature, swivel bearing 82 includes an exterior circumferential groove 85 having an upper flat side wall and a bevelled lower side wall which prevents monitor 10 from becoming disengaged from the mount in the event that the monitor is not fully pushed onto the mount housing 74. The bevelled lower wall of bearing groove 85 allows the downward passage of housing pins 32 but the flat upper wall of the bearing groove will prevent the upward passage of the pins unless the pins are withdrawn by turning of handle 57.

To remove the monitor 10 from the mount 70, an operator grasps handle 57 and turns it to cause pins 32 to be retracted into their unlocked positions shown in FIG. 7. The monitor 10 is then pulled upwardly until it disengages from the mount.

Figure 2:
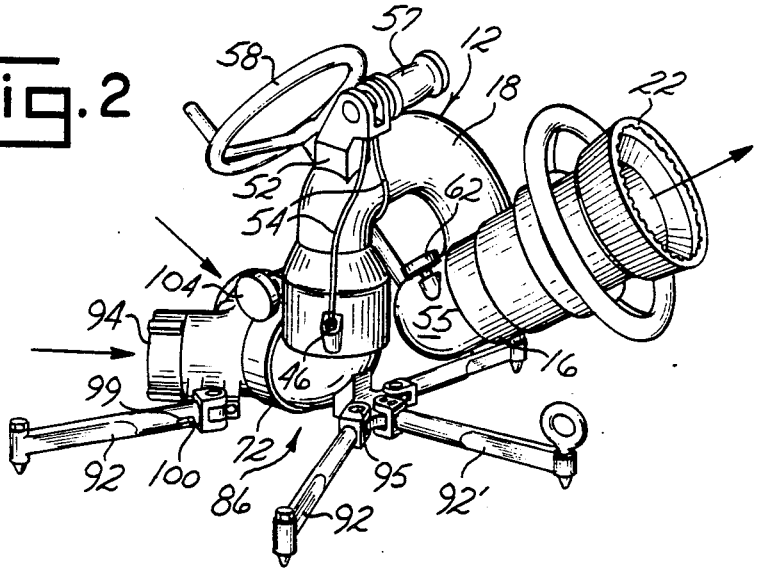
FIG. 2 is a perspective view of the monitor mounted to a portable stand.

FIG. 2 shows the monitor 10 being used on a portable, ground supported mount 86. Mount 86 includes spider like support legs 92, 92' and a base inlet 94. Base inlet 94 includes two inlet ports 95,97, separated by clapper valve 102, and is adapted for connection to the end of fire hose which may extend from a pumper. In some portable mounts, only one inlet port will be used. Mount 86 includes a conduit 72 which is in flow communication with inlet 94. A swivel bearing 82 extends about conduit 72. Conduit 72 and bearing 82 of mount 86 is like conduit 72 and bearing 82 of mount 10 and includes the same components. The process in attaching to and detaching the monitor 10 from mount 86 is the same as the aforedescribed process of attaching to and detaching the monitor from mount 70.

Figure 10:
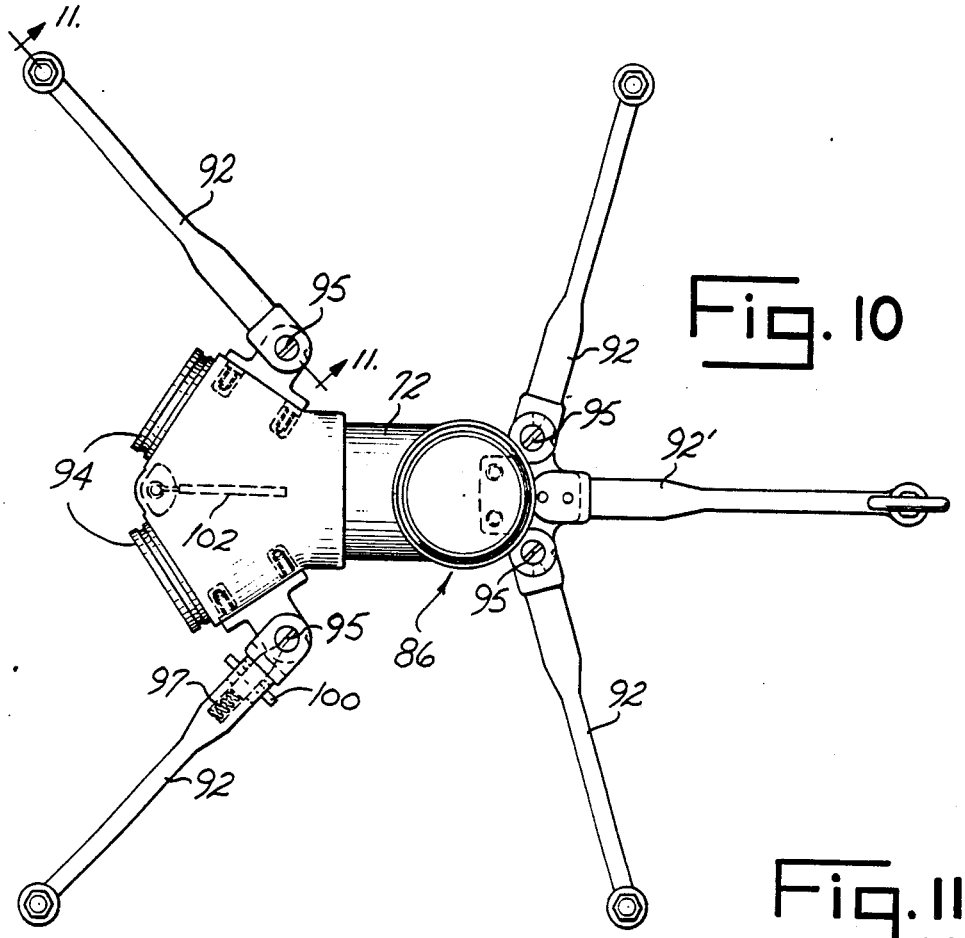
FIG. 10 is a top plan view of the portable stand in its operative position.
Figure 11:
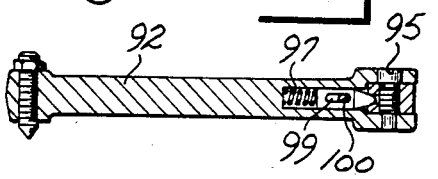
FIG. 11 is a sectional view taken along line 11—11 of FIG. 10.
Figure 12:
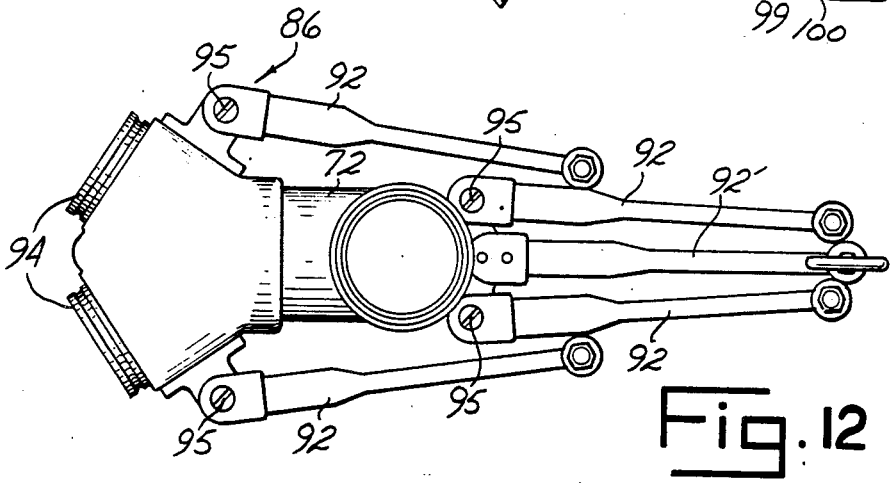
FIG. 12 is a top plan view of the portable stand in its storage position.

Legs 92 are pivotally connected to inlet 94 by pins 95. Each leg 92 carries a pin 100 which is biased by a spring 97 into selected spaced detents 99 formed in inlet 94 next to the pivot pin 95. This allows each leg 92 to be anchored in an extended use (FIG. 10) or a folded storage (FIG. 12) position 12 selected by the user.

Figure 4:
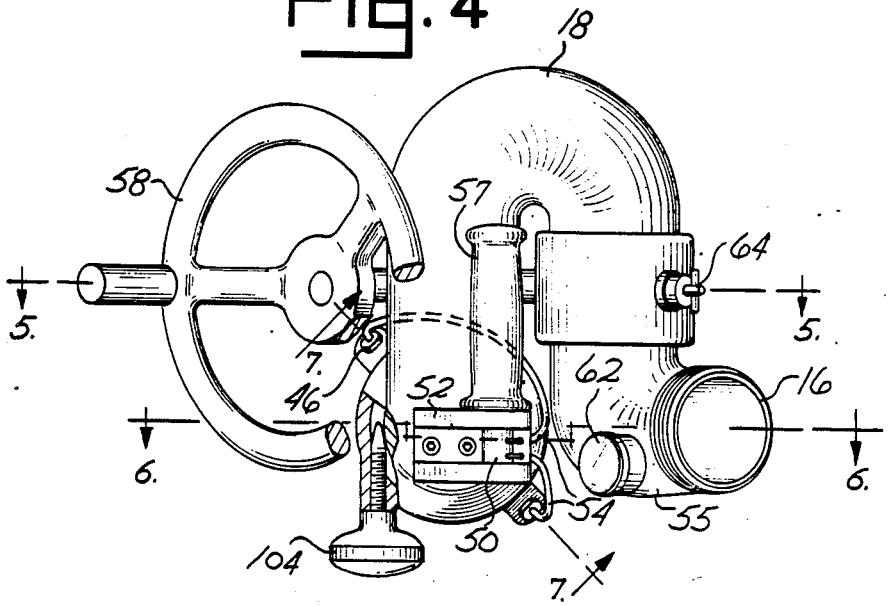
FIG. 4 is a top plan view of the monitor.

Constructed in this fashion, monitor 10 is easily convertible from use on a fixed mount such as attached to a fire fighting apparatus to a portable ground mount and vice versa. A wedge lock 104, seen in FIG. 4, may be provided to prevent rotation of monitor 10 about swivel bearing 82.

It is to be understood that the above description does not limit the invention to the details given above, but may be modified within the scope of the appended claims.

I claim:

1. In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet, said monitor housing including a snap-fitting connector detachably securing said housing inlet means to said mount outlet, said monitor housing further including actuator means for effecting movement of said snap-fitting connector between a locked position wherein the housing is secured to said mount, and an unlocked position wherein said monitor housing may be removed from said mount.

2. The monitor of claim 1 wherein said mount includes a shoulder, said snap-fitting connector including a pin carried by said monitor housing and shiftable between said locked position wherein said pin protrudes beneath said mount shoulder and said unlocked position wherein the pin is retracted from said shoulder.

3. The monitor of claim 2 and means for connecting said mount to said fluid source.

4. The monitor of claim 2 wherein said mount is connected to a fire vehicle.

5. The monitor of claim 2 wherein said mount is portable and includes leg means for ground engagement.

6. The monitor of claim 2 and biasing means for urging the pin into its said locked position, said mount including a camming surface means for engaging and urging said pin into its said unlocked position as said monitor is fitted downwardly over said mount outlet.

7. The monitor of claim 6 wherein said pin is positioned at an acute angle with respect to said mount shoulder and includes a continuous exterior annular groove, said groove constituting means for interlockingly engaging said mount shoulder.

8. The monitor of claim 6 wherein said mount includes an annular groove located spacedly from said mount shoulder, said groove constituting means for interlockingly engaging said monitor pin upon separating movement of the monitor relative to said mount.

9. The monitor of claim 2 wherein said mount outlet includes a bearing member, said monitor housing being rotatively carried by said mount bearing member, said mount bearing member including said mount shoulder.

10. The monitor of claim 2 wherein said snap-fitting connector includes a second said pin carried by said monitor housing, said second pin being angularly spaced about said monitor housing from the first mentioned said pin.

11. The combination of claim 2 wherein said actuation means includes a handle shiftably attached to said mount, and a cable connected between said handle and said pin, said handle shiftable between a first position with said cable extended and said pin in its locked position with a second position with said cable retracted to urge said pin into its said unlocked position.

12. In combination, a monitor comprising a housing having an inlet means for receiving fluid and an outlet means in flow communication with said inlet means for discharging said fluid from said housing, said monitor detachably connected to a mount adapted for connection to a fluid source, said mount including an outlet and a base, a plurality of legs extending from said base and adapted to support said mount on the ground, at least one of said legs including pivot means for movement between a support position and a folded position, said mount including a shoulder, a snap fitting connector detachably securing said monitor inlet to said mount outlet, said snap fitting connector including a pin carried by said monitor housing and shiftable between a locked position protruding beneath said mount shoulder and an unlocked position retracted from under said shoulder and means connected to said monitor for shifting said pin from its locked position into its said unlocked position.

13. The combination of claim 12 and biasing means for urging the pin into its said locked position, said mount including a camming surface means for engaging and urging said pin into its said unlocked position as said monitor is fitted downwardly over said mount outlet.

14. In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet, said monitor housing including a snap-fitting connector detachably securing said housing inlet means to said mount outlet, said mount including a shoulder, said snap-fitting connector including a pin carried by said monitor housing and shiftable between a locked position protruding beneath said mount shoulder and an unlocked position retracted from under said shoulder, actuator means for shifting said pin from its said locked position into its said unlocked position, said mount outlet including a bearing member with said monitor housing being rotatably carried by said mount bearing member when said pin is in its said locked position, said mount bearing member including said mount shoulder.

* * * * *

US004674686B1

REEXAMINATION CERTIFICATE (3829th)

United States Patent [19] [11] B1 4,674,686

Trapp [45] Certificate Issued Aug. 10, 1999

[54] PORTABLE FIRE APPARATUS MONITOR

[75] Inventor: James M. Trapp, Galien, Mich.

[73] Assignee: Elkhart Brass Manufacturing Co., Inc., Elkhart, Ind.

Reexamination Requests:
No. 90/003,552, Sep. 9, 1994
No. 90/003,949, Sep. 11, 1995

Reexamination Certificate for:

| | |
|---|---|
| Patent No.: | **4,674,686** |
| Issued: | **Jun. 23, 1987** |
| Appl. No.: | **06/656,072** |
| Filed: | **Sep. 28, 1984** |

[51] Int. Cl.[6] ..... B05B 15/06; A62C 31/28

[52] U.S. Cl. ..... 239/279; 169/24; 239/280.5; 239/587.2; 285/277; 285/317; 285/921

[56] References Cited

U.S. PATENT DOCUMENTS

| | | |
|---|---|---|
| 831,358 | 9/1906 | Lally . |
| 2,067,044 | 1/1937 | Corley . |
| 2,501,639 | 3/1950 | Warren . |
| 2,520,215 | 8/1950 | Kerr . |
| 3,796,448 | 3/1974 | Ringkamp . |
| 4,392,618 | 7/1983 | Evans et al. . |

FOREIGN PATENT DOCUMENTS

| | | |
|---|---|---|
| 1005629 | 4/1972 | France . |
| 834 165 | 8/1951 | Germany . |
| 873 045 | 7/1952 | Germany . |
| 887 300 | 12/1952 | Germany . |
| 873 045 | 4/1953 | Germany . |
| 887 300 | 8/1953 | Germany . |
| 260092 | 10/1926 | United Kingdom . |
| 449565 | 6/1936 | United Kingdom . |
| 1139439 | 1/1969 | United Kingdom . |
| 1139440 | 2/1969 | United Kingdom . |
| 1196584 | 7/1970 | United Kingdom . |

OTHER PUBLICATIONS

Akron Brass Company, Style 3422 Apollo brochure, Jun. 1983.
AWG Fire Fighting Equipment for Fire Fighting and Industrial Usage Publication, No. 212, Jul. 1983.
BS 336:1980, Specification for "Fire hose couplings and ancillary equipment".
Chubb Fire brochure entitled "JetMaster portable monitor," undated.
Halprin Catalog for Municipal and Industrial Fire & Safety Equipment, 1979.
Stang Hydronics Inc. specification sheet and drawing for Monitor Models BB3599 and C3600, stamped "Plaintiff's Exhibit 11," containing control Nos. TFT 1524 and TFT 1525.
Stang Hydronics Inc. pictures, drawing, specification for Monitor Models BB0308–1, BB0308–11, C3347–1, and C3347–11, containing control Nos. E000711–E000713.
Catalog entitled "AWG Fire–fighting systems fittings to German and foreign standards or for specified purposes" containing control Nos. TFT001326–TFT001416.
Elkhart Brass 293–6A Lightweight Single Wheel Operated Monitor, contained in Elkhart Fire Fighting Equipment Catalog–S sheets containing control Nos. TFT001009–TFT001011.
Jones Couplings, contained in Elkhart Brass catalog p. 59 and drawings containing control Nos. E001485–E001487.
Part No. 15626–B drawing containing control No. E002302.
W. S. Darley & Co. Automatic Universal Coupling shown in W. S. Darley & Co. Catalog 192, marked "Defendant's Exhibit 5" (containing control Nos. TFT001316–TFT001318) and in drawing marked "Defendant's Exhibit 5A" containing control No. TFT001604.
Walter Frank & Sons Ltd. Catalog, marked "Defendant's Exhibit 59" and containing control Nos. TFT 1606–TFT 1648.

*Primary Examiner*—Andres Kashnikow

[57] ABSTRACT

A monitor which is for directing fluid flow from a fire truck pumper and which includes a spring biased latch pin securing the monitor to either a portable or permanent mount having a circumferential swivel bearing.

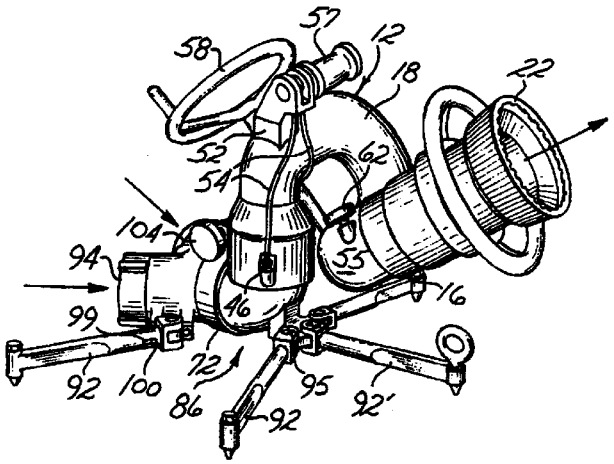

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 14 is confirmed.

Claim 2 is cancelled.

Claims 1 and 3–12 are determined to be patentable as amended.

Claim 13, dependent on an amended claim, is determined to be patentable.

New claims 15–26 are added and determined to be patentable.

1. In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet *and including a shoulder, one of said housing inlet means and said mount outlet including a rotatable bearing member and the other of said housing inlet means and said mount outlet selectively mating with said rotatable bearing member*, said monitor housing including a snap-fitting connector detachably securing said housing inlet means to said mount outlet *at said rotatable bearing member*, said monitor housing further including actuator means for effecting movement of said snap-fitting connector between a locked position wherein the housing is secured to said mount, and an unlocked position wherein said monitor housing may be removed from said mount*, and said snap-fitting connector including a pin carried by said monitor housing and shiftable between said locked position wherein said pin protrudes beneath said mount shoulder and said unlocked position wherein the pin is retracted from said shoulder.*

3. The monitor of claim [2] *1* and means for connecting said mount to said fluid source.

4. The monitor of claim [2] *1* wherein said mount is connected to a fire vehicle.

5. The monitor of claim [2] *1* wherein said mount is portable and includes leg means for ground engagement.

6. The monitor of claim [2] *1* and biasing means for urging the pin into its said locked position, said mount including a camming surface means for engaging and urging said pin into its said unlocked position as said monitor is fitted downwardly over said mount outlet.

7. [The monitor of claim 6 wherein] *In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet and said mount including a shoulder, said monitor housing including a snap-fitting connector detachably securing said housing inlet means to said mount outlet, said monitor housing further including actuator means for effecting movement of said snap-fitting connector between a locked position wherein the housing is secured to said mount and an unlocked position wherein said monitor housing may be removed from said mount, said snap-fitting connector including a pin carried by said monitor housing and shiftable between said locked position wherein said pin protrudes beneath said mount shoulder and said unlocked position wherein the pin is retracted from said shoulder, biasing means for urging the pin into its said locked position, said mount including a camming surface means for engaging and urging said pin into its said unlocked position as said monitor is fitted downwardly over said mount outlet,* said pin [is] positioned at an acute angle with respect to said mount shoulder and [includes] *including* a continuous exterior annular groove, said groove constituting means for interlockingly engaging said mount shoulder.

8. [The monitor of claim 6 wherein] *In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet and said mount including a shoulder, said monitor housing including a snap-fitting connector detachably securing said housing inlet means to said mount outlet, said monitor housing further including actuator means for effecting movement of said snap-fitting connector between a locked position wherein the housing is secured to said mount and an unlocked position wherein said monitor housing may be removed from said mount, said snap-fitting connector including a pin carried by said monitor housing and shiftable between said locked position wherein said pin protrudes beneath said mount shoulder and said unlocked position wherein the pin is retracted from said shoulder, biasing means for urging the pin into its said locked position, said mount including a camming surface means for engaging and urging said pin into its said unlocked position as said monitor is fitted downwardly over said mount outlet,* said mount [includes] *including* an annular groove located spacedly from said mount shoulder, said groove constituting means for interlockingly engaging said monitor pin upon separating movement of the monitor relative to said mount.

9. [The monitor of claim 2] *In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet, said monitor housing including a snap-fitting connector detachably securing said housing inlet means to said mount outlet, said monitor housing further including actuator means for effecting movement of said snap-fitting connector between a locked position wherein the housing is secured to said mount, and an unlocked position wherein said monitor housing may be removed from said mount, wherein said mount includes a shoulder, said snap-fitting connector including a pin carried by said monitor housing and shiftable between said locked position wherein said pin protrudes beneath said mount shoulder and said unlocked position wherein the pin is retracted from said shoulder,* wherein said mount outlet includes a bearing member, said monitor housing being rotatively carried by said mount bearing member, said mount bearing member including said mount shoulder.

10. The monitor of claim [2] *1* wherein said snap-fitting connector includes a second said pin carried by said monitor housing, said second pin being angularly spaced about said monitor housing from the first mentioned said pin.

11. [The combination of claim 2 wherein] *In combination, a monitor for directing the flow of pressurized fluid from a fluid source, said monitor comprising a housing having an inlet means for receiving said fluid and an outlet means in flow communication with said inlet means for discharging said fluid from said housing, a mount adapted for connection to said fluid source and including an outlet and said mount including a shoulder, said monitor housing including a snap-fitting connector detachably securing said housing inlet means to said mount outlet, said monitor housing further including actuator means for effecting movement of said snap-fitting connector between a locked position wherein the housing is secured to said mount and an unlocked position wherein said monitor housing may be removed from said mount, said snap-fitting connector including a pin carried by said monitor housing and shiftable between said locked position wherein said pin protrudes beneath said mount shoulder and said unlocked position wherein the pin is retracted from said shoulder,* said [actuation] *actuator* means [includes] *including* a handle shiftably attached to said mount, and a cable connected between said handle and said pin, said handle shiftable between a first position with said cable extended and said pin in its locked position [with] *and* a second position with said cable retracted to urge said pin into its said unlocked position.

12. In combination, a monitor comprising a housing having an inlet means for receiving fluid and an outlet means in flow communication with said inlet means for discharging said fluid from said housing, said monitor detachably connected to a mount adapted for connection to a fluid source, said mount including an outlet and a base, *one of said housing inlet means and said mount outlet including a rotatable bearing member and the other of said housing inlet means and said mount outlet selectively mating with said rotatable bearing member,* a plurality of legs extending from said base and adapted to support said mount on the ground, at least one of said legs including pivot means for movement between a support position and a folded position, said [mount] *bearing member* including a shoulder, a [snap fitting] *snap-fitting* connector detachably securing said monitor inlet to said mount outlet, said [snap fitting] *snap-fitting* connector including a pin carried by said monitor housing and shiftable between a locked position protruding beneath said [mount] *bearing member* shoulder and an unlocked position retracted from under said shoulder and means connected to said monitor for shifting said pin from its locked position into its said unlocked position.

*15. The monitor of claim 1 wherein said snap-fitting connector is spring biased.*

*16. The monitor of claim 15 wherein said snap-fitting connector is biased towards said locked position.*

*17. The monitor of claim 1 wherein said other of said housing inlet means and said mount outlet defines an enlarged orifice in which said bearing member is selectively received.*

*18. The monitor of claim 9 wherein said snap-fitting connector is spring biased.*

*19. The monitor of claim 18 wherein said snap-fitting connector is biased towards said locked position.*

*20. The monitor of claim 9 wherein said housing inlet means defines an enlarged orifice in which said bearing member is selectively received.*

*21. The monitor of claim 11 wherein said snap-fitting connector is spring biased.*

*22. The monitor of claim 21 wherein said snap-fitting connector is biased towards said locked position.*

*23. The monitor of claim 11 wherein said housing inlet means defines an enlarged orifice in which said bearing member is selectively received.*

*24. The monitor of claim 12 wherein said snap-fitting connector is spring biased.*

*25. The monitor of claim 24 wherein said snap-fitting connector is biased towards said locked position.*

*26. The monitor of claim 12 wherein said other of said housing inlet means and said mount outlet defines an enlarged orifice in which said bearing member is selectively received.*

* * * * *